US005372290A

United States Patent [19]

Marmin

[11] Patent Number: 5,372,290

[45] Date of Patent: Dec. 13, 1994

[54] APPARATUS FOR REMOVING A RUNNING TORN WEB OF MATERIAL

[76] Inventor: Jean C. Marmin, 22 Allee des Hirodelles 60190 Estrees St., Denis, France

[21] Appl. No.: 71,631

[22] Filed: Jun. 3, 1993

[30] Foreign Application Priority Data

Jun. 25, 1992 [FR] France ..... 92 07805

[51] Int. Cl.[5] ..... B41F 13/54

[52] U.S. Cl. ..... 226/91; 101/228; 226/97

[58] Field of Search ..... 226/24, 36, 91, 92, 226/97, 45; 101/228, 484, 217, 219

[56] References Cited

U.S. PATENT DOCUMENTS

| | | | |
|---|---|---|---|
| 3,743,153 | 7/1973 | Moss | 26/113 X |
| 4,549,485 | 10/1985 | Nawrath | 101/219 |
| 4,754,702 | 7/1988 | Müller | 101/228 |
| 5,163,371 | 11/1992 | Kotterer et al. | 101/484 |

FOREIGN PATENT DOCUMENTS

| | | | |
|---|---|---|---|
| 0092659 | 5/1986 | European Pat. Off. | B41F 13/02 |
| 0476437 | 3/1992 | European Pat. Off. | B65H 26/02 |
| 2242826 | 3/1974 | Germany . | |
| 3735330 | 5/1988 | Germany | B41F 33/06 |
| 3822496 | 1/1990 | Germany | B41F 33/06 |

*Primary Examiner*—Daniel P. Stodola
*Assistant Examiner*—John Q. Nguyen
*Attorney, Agent, or Firm*—Kenyon & Kenyon

[57] ABSTRACT

An apparatus for removing a running torn web of material is disclosed having two rollers parallel to each another disposed on a same side of the running web of material, so that the axes of the two rollers are orientated horizontal to each other and perpendicular to the direction of movement of the running web of material. The apparatus is provided with a manifold disposed on the side of the web opposite to the two rollers and provided with blowing nozzles placed in line with an inlet region formed by the two rollers in rotation. The manifold is supplied with compressed air when a detection system has detected the tearing of the web. The compressed air exits the blowing nozzles exerting a blowing force on the torn web of material causing it to engage between the two parallel rollers in rotation. A variable speed motor is provided to drive the two rollers in rotation in opposite directions while their circumferential surfaces are in mutual rotational engagement, so that the two rollers have a surface speed approximately equal to the speed of the running web of material.

12 Claims, 4 Drawing Sheets

APPARATUS FOR REMOVING A RUNNING TORN WEB OF MATERIAL

FIELD OF THE INVENTION

The present invention relates to an apparatus for automatically catching and removing a running torn web of material. The present invention is particularly useful in an offset printing press. It prevents choking caused by winding of a running torn web of paper onto a blanket cylinder in the last printing unit of the press.

BACKGROUND OF THE INVENTION

Printing units in offset printing presses usually comprise four parallel cylinders, which are mutually in surface contact through one of their generatrices. A web of printed paper runs between the two central cylinders known as blanket cylinders which transfer printing ink from plate cylinders to the running web of paper. The blanket cylinders are fitted with printing blankets formed of a cloth coated with an elastomer material. Due to the viscous characteristic of the printing ink transferred to the printed web of paper, the printed web has a tendency to adhere to the printing blankets on the blanket cylinders which are damp.

During operation of the printing press, the running web of paper is under a high tension stress created by entry rollers situated before the printing units and cooling rollers situated after the printing units and dryer. The tension in the web causes the web to peel off of the damp printing blankets. This peeling off of the web from the printing blankets is sometimes abrupt, causing the web to tear.

Furthermore, when offset printing inks of the hot-drying type are used, a hot air dryer is provided in the printing press. The hot air dryer is usually between 8 and 12 meters long and is designed to cause the solvents of the ink deposited on the web of paper to evaporate and to cause its resin to be cured. The hot air dryer is placed after the last printing unit. The printed web of paper runs through the hot air dryer without any support by rollers. Since the dried web of paper is less resilient than the damp web of paper, tearing of the web of paper may also occur in the dryer.

When the web of paper tears in the dryer, it usually winds itself onto one of the blanket cylinders in the last printing unit as a result of the adhesion of the ink deposited on the web, which can create considerable bonding forces. After a certain number of revolutions, when the number of layers of paper reaches a critical mass, the torn web of paper winding itself onto the blanket cylinder can ruin the printing blanket or even the cylinders. Before the printing press comes to a complete stop, the risk of incident is increased, since for each revolution of the blanket cylinder, two layers of paper are wound around the blanket cylinder, one of which comes from the printing unit and the other from the dryer.

A non-return device disclosed in European Patent EP-0,092,659 attempts to overcome the above-mentioned disadvantages. This device is placed between the last printing unit and the dryer. The main component of this device is a pair of gripping rollers, comprising one fixed roller laterally set underneath the running web of paper and one pressure roller disposed above the web, both rollers being driven in rotation at the running speed of the web. During normal operation when the web is running, the two rollers are separated so that the damp printed web can pass without touching them and so that there is no mackling. When the web of paper tears, the breakage of the web is detected by optical detectors placed at the output of the last printing unit and a trigger signal is instantaneously sent to a mechanism holding the pressure roller apart. The pressure roller is then released and brought into a position for gripping the torn web of paper. As long as the printing press is still running, the web of paper from the last printing unit continues to run and winds itself onto one of the two gripping rollers, instead of winding itself onto one of the blanket cylinders in the last printing unit. The diameter of the roller around which the paper winds itself increases while the other roller moves apart so as to permit the reception of the paper.

As the diameter of the roller onto which the web of paper winds itself increases, this roller has a tendency to wind an increasing length of paper web at each revolution. The roller thus exerts an increasingly greater tension on the web of paper which in itself creates the possibility of tearing. In order to avoid this, it would be necessary to fit the device with a friction clutch system. The friction clutch system would make it possible to adjust the drive of the two gripping rollers, so that the rollers would begin to slip once the tension in the torn web of paper became too great; such slippage would progressively increase as the diameter of the winding roller increased. The fitting of such a clutch system is complex and there is no guarantee that it would solve the tearing problem.

Moreover, the torn web of paper winding itself around the gripping roller is coated with damp ink and when the printing machine is stopped, it is then difficult to remove all of this paper stuck onto the roller.

Lastly, the two gripping rollers turning close to each other on either side of the running web of paper, risk coming into close contact at any moment, which presents a danger to the personnel on duty.

SUMMARY OF THE INVENTION

In order to overcome the various above-mentioned drawbacks of the prior art, the present invention provides an apparatus for removing a running torn web of material comprising two rollers parallel to each other disposed on a same side of the running web of material so that the axes of the rollers are orientated horizontal to each other and perpendicular to the direction of movement of the running web of material. The apparatus further comprises means for engaging the torn web of material in an inlet region formed by the two rollers in rotation, the engaging means disposed on the side of the web of material opposite to the two rollers. Drive means are also provided to drive the two parallel rollers in rotation in opposite directions while their circumferential surfaces are mutually engaged at the level of one of their generatrices, so that the two rollers have a surface speed approximately equal to the speed of running the web of material.

When the running web of material tears, the apparatus according to the present invention makes it possible to recover the torn web of material, which continues to run, by engaging it between the two rollers in rotation, so that the torn web of material is then pulled by the two rollers at the running speed of the web in order to be cleared into a storage basket, without the web winding itself around one of the two rollers of the printing press.

According to one embodiment of the present invention, the engagement means comprises a manifold disposed on the side of the web of material opposite to the two rollers and provided with blowing means placed in line with the inlet region. The manifold is supplied with compressed air stored in a reservoir by an electrovalve in response to a signal from a detection system which detects a tear in the web of material. Thus, when the detection system of the present invention detects a tearing of the running web of material, for example in the dryer of a printing press, the manifold is supplied with compressed air and the blowing means exerts a blowing force on the torn web of material, so as to engage it between the two parallel rollers in rotation.

The apparatus according to the present invention further provides means for scraping the web of material off of the two rollers so as to prevent the winding of the web of material onto either of the two rollers. This prevents choking of the removing apparatus.

Other objects, characteristics and advantages of the present invention will become apparent in view of the following detailed description and accompanying drawings.

DETAILED DESCRIPTION

Figure 1:
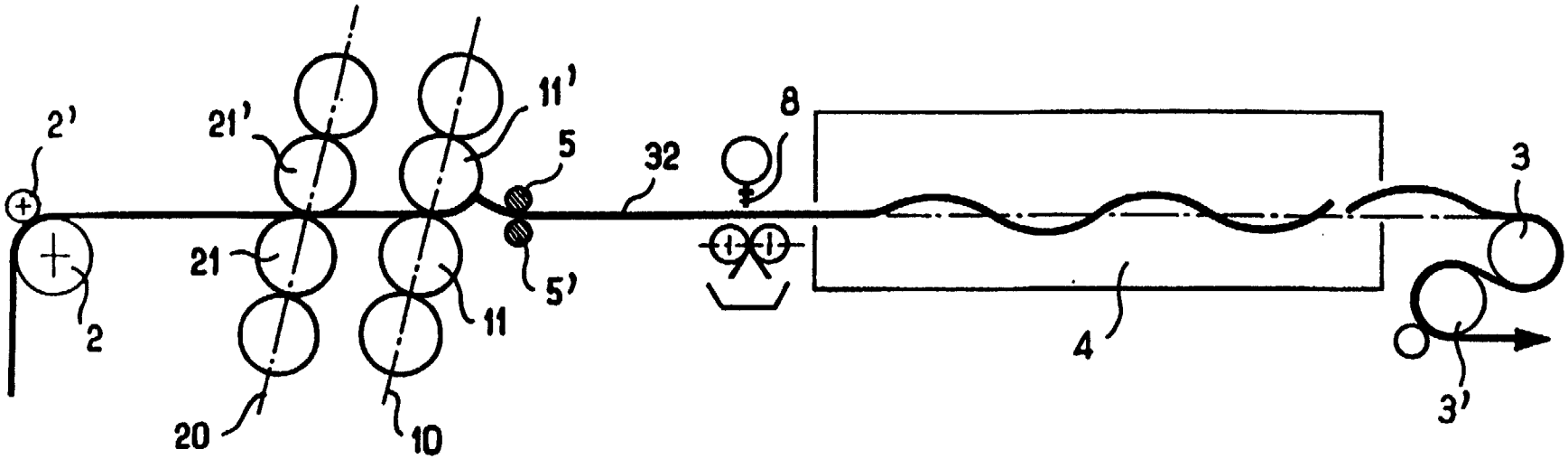
FIG. 1 is a partial side elevational view of an offset printing press with a hot air dryer comprising an apparatus for removing a running torn web of paper according to the present invention.

Referring to FIG. 1, an offset printing press with a hot air dryer is shown with two printing units 10, 20 each comprising two blanket cylinders 11, 11, 21, 21, respectively, disposed on either side of a web of paper 32 which runs horizontally through the cylinders. The press further comprises a dryer 4 placed after the last printing unit 10. As shown in FIG. 1, the web of paper 32 is stretched between two entry rollers 2, 2' and two exit rollers 3, 3'. Moreover, a detection system 5, 5'; which in the embodiment described is placed just after the last printing unit 10, serves to detect a tearing of the web of paper 32 and to send a start signal to the apparatus for removing a running torn web of material according to the present invention, positioned just at the entry of the dryer 4 and referenced by numeral 8 in FIG. 1. Of course, as one of ordinary skill in the art will appreciate, the detection system 5, 5! can be placed anywhere between the last printing unit 10 and the two exit rollers 3, 3'.

Figure 2:
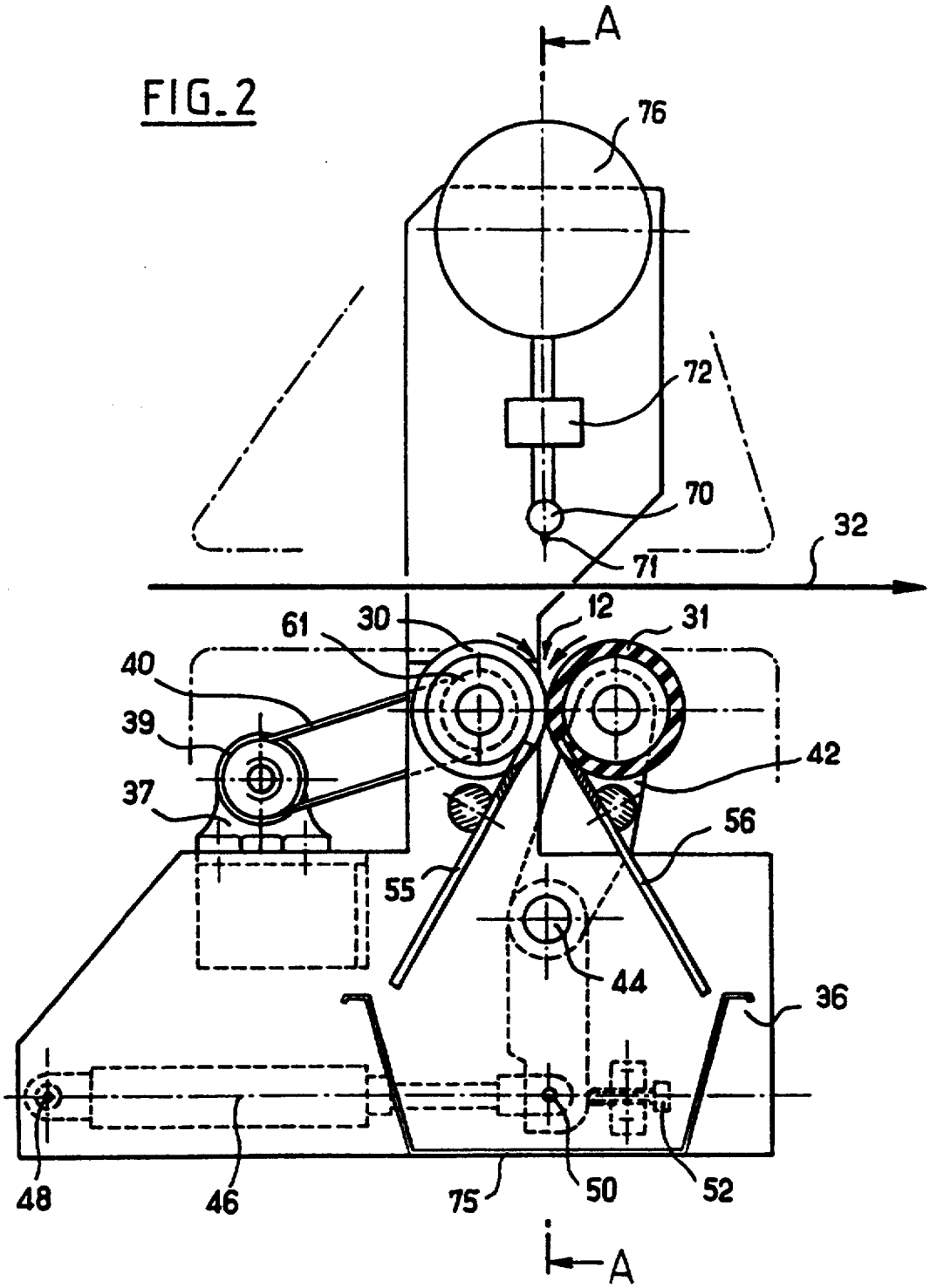
FIG. 2 is a front elevational view of the apparatus for removing a running torn web of paper according to the present invention.
Figure 3:
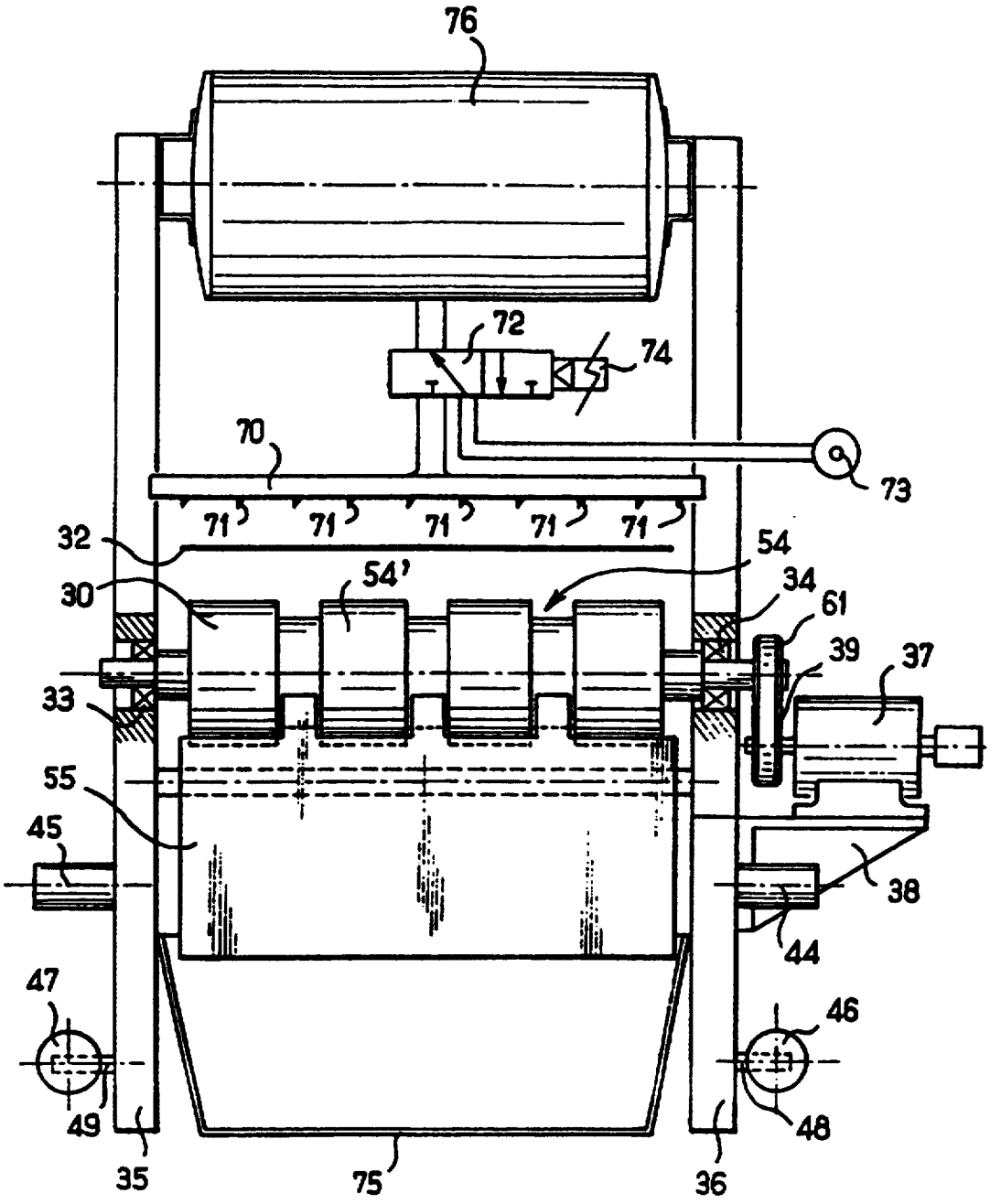
FIG. 3 is a cross-sectional view of the apparatus according to the present invention shown in FIG. 2 along the plane A—A.
Figure 4:
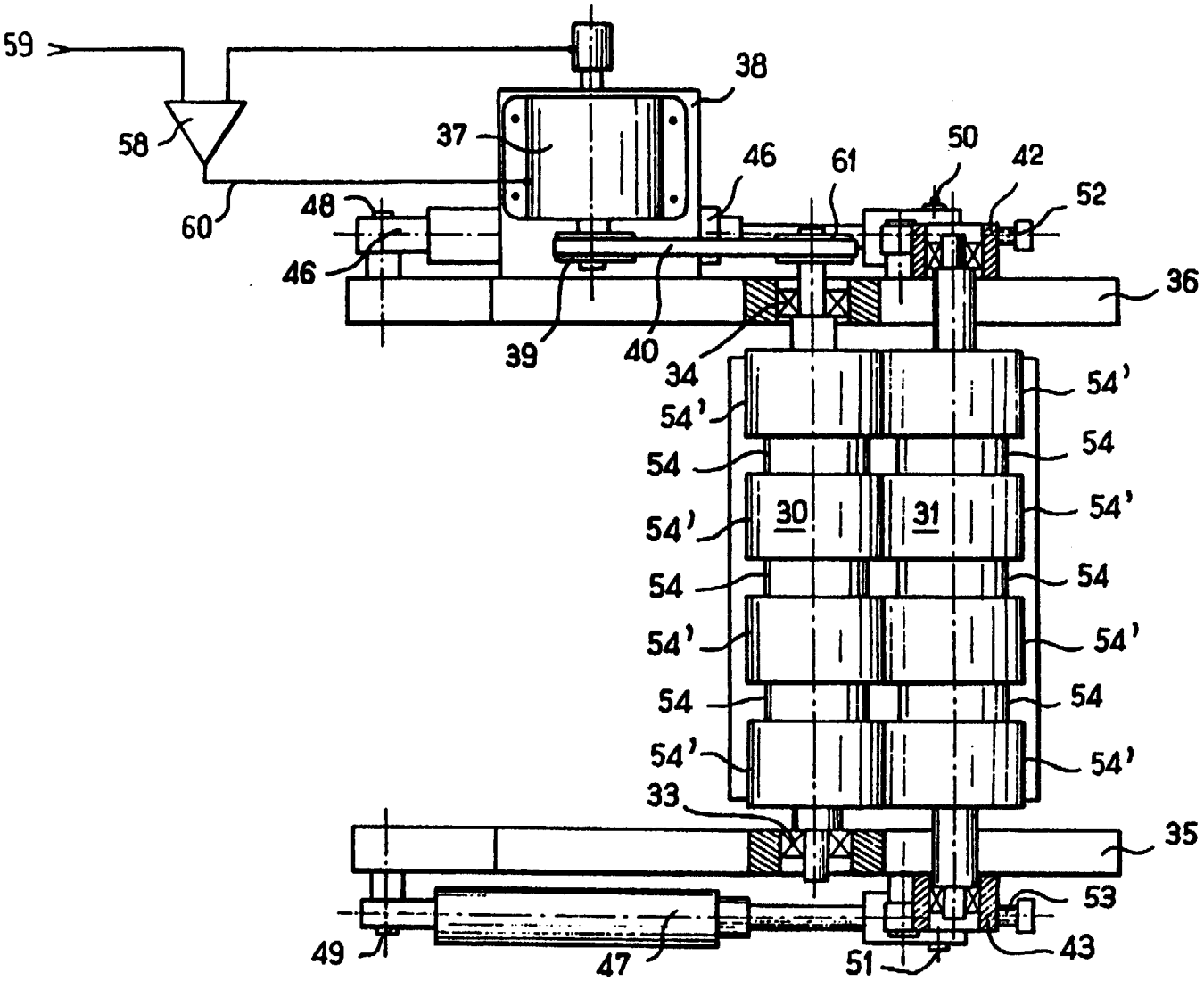
FIG. 4 is a partial top elevational view of the apparatus according to the present invention shown in FIG. 2.

FIGS. 2, 3 and 4 show in greater detail the apparatus for removing a running torn web of material according to the present invention. The apparatus comprises two rollers 30, 31 each of diameter equal to about 120 millimeters, parallel to each another and disposed on a same side of the web of paper 32 moving horizontally. More precisely, the two rollers 30, 31 are placed underneath the web of paper 32, so that the axes of the rollers 30, 31 are orientated horizontal to each other and perpendicular to the direction of movement of the web of paper. The rollers 30, 31 are formed of a metal such as steel. Preferably, the roller 30 has a bare surface and the roller 31 has a surface clad superficially with rubber.

Furthermore, as can be better seen in FIGS. 3 and 4, the rollers 30, 31 are both provided with several circular grooves 54 disposed longitudinally along the circumferential surface of each roller at regular intervals, so that the surface of each of the rollers is defined by adjacent projecting parts 54' and recessed parts 54. Moreover, the rollers 30, 31 are driven in rotation in opposite directions by drive means explained in greater detail below. According to the embodiment shown in FIGS. 2, 3 and 4, the roller 30 turns in the direction of movement of the web of paper 32 and the roller 31 turns in an opposite direction. The two rollers driven in rotation create below the web of paper 32 an inlet region 12. The roller 31 is mounted on an articulation device described later, so that the circumferential surfaces of the two rollers are mutually engaged at the level of the projecting parts 54' and more particularly at the level of one of their generatrices.

As can be seen in FIGS. 3 and 4, the roller 30 is mounted in pivoting manner on two bearings 33 and 34 disposed on two parallel bearing housings 35, 36, respectively. The roller 30 comprises a drive pulley 61 fixed by keying onto one of its trunnions and connected by a belt 40 to a pulley 39 mounted on drive means, e.g., an electric motor 37. The motor 37 is preferably of a variable speed type and is mounted on a bracket 38 connected to the bearing housing 36 so that the axis of the motor 37 is parallel to the axis of the roller 30, as shown in FIG. 3. The roller 30 is driven by the motor 37 at approximately the running speed of the web of paper 32.

Furthermore, as can be seen in FIGS. 2, 3 and 4, the roller 31 comprising at each end two trunnions, is mounted in free rotation on the articulation device, here, two levers 42, 43, mounted respectively in rotation on the bearing housings 35, 36 by means of two pivots 44, 45. Two pneumatic jacks 46, 47 pivotally mounted about pivot points 48, 49 respectively on the bearing housings 35, 36 comprise rods 50, 51 respectively. The pneumatic jacks 46, 47 act on the levers 42, 43 to move the roller 31 into contact with and away from the roller 30. Screws 52, 53 are used to adjust the surface contact of the roller 31 against the roller 30 by limiting the rotation of the levers 42, 43. In normal operation, the pneumatic jacks 46, 47 are activated, so that the contact between the two rollers 30, 31 is at a minimum so as to avoid any heating of the rubber attached to the surface of the roller 31.

In addition, the electric motor 37 turns at a speed proportional to the speed of the printing press, operating in the following manner. The speed of rotation of the motor 37 is converted into electrical voltage transmitted into an electronic circuit 58 and compared with a voltage transmitted by the conductor 59 coming from the main drive motor (not shown) of the printing press, as shown schematically in FIG. 4. In return, the electronic circuit 58 produces with precision a supply voltage 60 for the motor 37, so that its rotation speed is proportional to the speed of the printing press. The apparatus according to the present invention further comprises scrapers 55, 56 in the form of combs corresponding to rollers 30, 31 respectively, as shown in FIGS. 2 and 3. The scraper 55 associated with the roller 30 is mounted on the bearing housings 35, 36 so that the teeth of the comb project into the grooves 54 of the roller 30. The scraper 56 of the roller 31 is mounted on the two levers 42, 43 and is identical to the scraper 55. It is disposed in front of the roller 31 so that the teeth of the comb engage in the grooves 54 of the roller 31. The scrapers 55, 56 operate to prevent the winding of the torn web of paper 32 onto either of the two rollers 30, 31.

As shown in FIGS. 2 and 3, the apparatus according to the present invention also comprises means for engaging the torn web of paper in the inlet region, here a manifold 70 disposed on the side of the web of paper 32 opposite to the rollers 30, 31. In this embodiment, the manifold 70 is placed above the web of paper 32. The manifold 70 comprises blowing means, here a plurality of blowing nozzles 71 distributed along an axis parallel to the axes of the rollers 30, 31, i.e., perpendicular to the direction of feed of the web of paper 32, as shown in FIG. 3.

In the preferred embodiment, the rollers 30, 31 are placed underneath the web of paper at a spacing distance of approximately 20 millimeters, and the manifold 70 is disposed above the web of paper at a distance of approximately 20 millimeters. The blowing nozzles 71 are distributed, for example, every 100 millimeters over the maximum width of the web of paper. The diameter of these nozzles is between 3 and 5 millimeters. The manifold 70 is supplied at its middle with compressed air at a pressure for example of $7\times10^5$ Pa. This supply is triggered by the detection system 5, 5' when it detects a tearing of the web of paper 32. The blowing nozzles 71 blow the compressed air onto the torn web of paper 32 to effect engagement in the inlet region 12 formed by the two rollers 30, 31 in rotation. The two rollers 30, 31 in mutual contact, thus pull the torn web of paper 32, engaged in the inlet region 12, even if the web is crumpled or otherwise creased.

In order to obtain a sufficient supply of compressed air without reduction of the pressure in the compressed air system, the apparatus according to the present invention comprises a reservoir 76 placed near the manifold 70. The reservoir 76 and the manifold 70 are connected to a compressed air supply network 73 by means of an electrovalve 72 of known type, as shown in FIG. 3. Moreover, the electrovalve 72 is connected to the detection system 5, 5' so as to be actuated by an electrical signal sent from the detection system 5, 5' when it detects a tearing of the web of paper 32.

When the electrovalve 72 is at rest, i.e., when the web of paper 32 is running at normal speed, it connects the reservoir 76 to the compressed air supply network 73 so that the reservoir 76 is filled with compressed air. At this time, the manifold 70 is not supplied with compressed air. When the electrovalve 72 receives the electrical signal from the detection system 5, 5', it cuts off the supply of compressed air to the reservoir 76 and connects the reservoir directly to the manifold 70.

Once supplied with compressed air, the manifold 70 exerts, through the blowing nozzles 71, a dynamic pressure on the torn web of paper 32 which operates to engage the torn web in the inlet region 12 of the two rollers 30, 31. The web thus engaged is pulled by the rollers 30, 31 in mutual contact and directed into a receiver basket 75 disposed underneath the scrapers 55, 56. If the web of paper 32 should crumple, crease or get caught between the two rollers 30, 31, the pneumatic jacks 46, 47, under constant pressure, behave like resilient means and allow the rollers 30, 31 to separate while maintaining a constant grip on the web. After the printing press shuts down, the rollers 30, 31 can be separated to facilitate removing of the torn web. At this time, the receiver basket 75 can be emptied and the web of paper 32 can be reengaged in the printing press.

The present invention is by no means limited to the embodiments described and shown herein. Rather, it is intended to encompass all modifications and variations envisioned by persons of ordinary skill in the art. For example, according to one modification of the embodiment shown in FIGS. 2, 3 and 4, the rollers 30, 31 may both have smooth bare metal surfaces or both have surfaces clad with rubber. Furthermore, the rollers 30, 31 may be disposed above the web of paper, and the manifold 70 may be disposed underneath the web of paper 32. The roller 30 may also be mounted in free rotation and the roller 31 may be driven in rotation by the electric motor 37. According to another modification of the embodiment of the apparatus according to the present invention shown in FIGS. 2, 3 and 4, the means for driving the roller 30 at variable speeds may comprise a mechanical transmission system connected directly to the drive mechanism of the printing press through belts or the like.

I claim:

1. An apparatus for removing a running torn web of material, comprising:

two rollers parallel to each other forming a nip for the web and disposed on a same side of the running web of material so that the axes of the rollers are orientated horizontal and perpendicular to the direction of movement of the running web of material; and means for engaging the torn web of material and introducing the web into an inlet region formed by the two rollers in rotation, the engaging means disposed on the side of the web of material opposite to the two rollers.

2. The apparatus according to claim 1, further comprising means for rotatably driving the two rollers in opposite directions, while the circumferential surfaces of the two rollers are in mutually rotatable engagement, so that the two rollers have a surface speed approximately equal to the speed of the web of material.

3. The apparatus according to claim 2, wherein the means for rotatably driving comprises a variable speed motor driving in rotation at least one of the two rollers.

4. The apparatus according to claim 1, wherein the engaging means comprises a manifold having a blowing means placed in line with the inlet region, the manifold being supplied with compressed air in response to a signal sent by a detection system detecting the tearing of the web of material.

5. The apparatus according to claim 4, wherein the blowing means comprises a plurality of blowing nozzles distributed along an axis parallel to the axes of the two rollers.

6. The apparatus according to claim 5, wherein the engaging means further comprises a reservoir for storing the compressed air to be supplied to the manifold.

7. The apparatus according to claim 6, wherein the engaging means further comprises an electrovalve which connects the reservoir to a network for supplying the manifold with compressed air, the electrovalve being connected to the detection system so as to simultaneously supply the manifold with the air stored in the reservoir in response to the signal sent from the detection system communicating that the web of material has been torn.

8. The apparatus according to claim 1, further comprising means for moving the circumferential surfaces of the two rollers into mutual rotational engagement during removal of the torn web of material from the printing press.

9. The apparatus according to claim 8, wherein the moving means comprises two levers on which one of the two rollers is mounted in free rotation, each of the two levers being acted upon by a pneumatic jack.

10. The apparatus according to claim 1, further comprising means for scraping the web of material off of the two rollers so as to prevent the winding of the web of material onto either of the two rollers.

11. The apparatus according to claim 10, wherein the scraping means comprises a scraper corresponding to each of the two rollers, each scraper being in the form of a comb.

12. The apparatus according to claim 1, wherein at least one of the two rollers is clad on its surface with a rubber covering.

* * * * *

UNITED STATES PATENT AND TRADEMARK OFFICE

CERTIFICATE OF CORRECTION

PATENT NO. : 5,372,290

DATED : December 13, 1994

INVENTOR(S) : Jean C. MARMIN

It is certified that error appears in the above-identified patent and that said Letters Patent is hereby corrected as shown below:

| Column | Line | |
|---|---|---|
| 3 | 56 | Change "5, 5!" to --5, 5′--. |
| 4 | 62 | After "press." start a new paragraph. |

Signed and Sealed this

Fifth Day of November, 1996

*Attest:*

*Attesting Officer*

Bruce Lehman

BRUCE LEHMAN

*Commissioner of Patents and Trademarks*